United States Patent [19]

Gerstmann

[11] 4,175,706

[45] Nov. 27, 1979

[54] SPRAY NOZZLE

[75] Inventor: Joseph Gerstmann, Sudbury, Mass.

[73] Assignee: Scientific Energy Systems Corporation, East Natick, Mass.

[21] Appl. No.: 816,487

[22] Filed: Jul. 18, 1977

[51] Int. Cl.[2] ..... B05B 7/26

[52] U.S. Cl. ..... 239/414; 239/434.5

[58] Field of Search ..... 239/405, 406, 409, 414, 239/416, 417, 433, 434, 434.5, 424

[56] References Cited

U.S. PATENT DOCUMENTS

| | | | |
|---|---|---|---|
| 1,289,812 | 12/1918 | Kinney | 239/434.5 |
| 1,291,012 | 1/1919 | Joiner | 239/434.5 |
| 2,054,136 | 9/1936 | Pfaff et al. | 239/434.5 |
| 2,213,522 | 9/1940 | Holmboe et al. | 239/434 |
| 2,539,315 | 1/1951 | Murphy | 239/424 X |
| 3,383,049 | 5/1968 | Guerin | 239/406 X |
| 3,923,246 | 12/1975 | Cloutier | 239/434 |

FOREIGN PATENT DOCUMENTS

| | | | |
|---|---|---|---|
| 1429682 | 1/1966 | France | 239/417 |

*Primary Examiner*—John J. Love

*Attorney, Agent, or Firm*—Edgar H. Kent

[57] ABSTRACT

A spray nozzle has a nozzle body defining therein a tubular chamber with an outer wall of generally circular cross-section. A generally coaxial discharge orifice at an end of this chamber has a bounding surface externally of the chamber which forms an included angle toward the chamber of less than 110° with the axis of the chamber. Passage means are provided in the nozzle body to receive a flow of liquid to be sprayed and having an outlet arranged to discharge the liquid into the chamber as an annulus about the axis of the chamber. Means is provided for directing gas under pressure into the chamber in a flow path past the outlet and out the orifice, with any chamber wall portions defining the flow path between the outlet and the orifice being convergent toward the orifice in the direction of flow.

17 Claims, 20 Drawing Figures

FIG 3
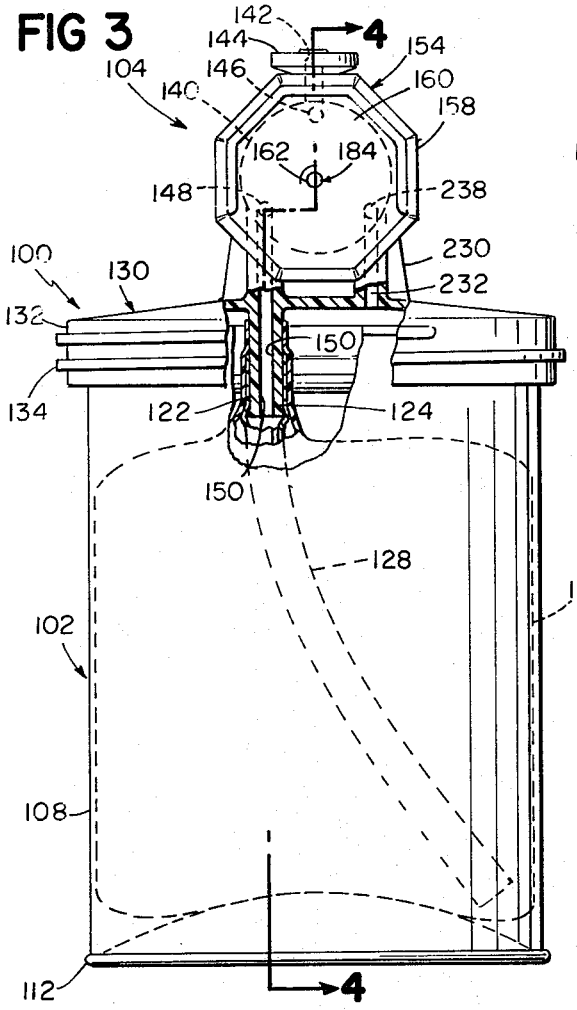
FIG 4
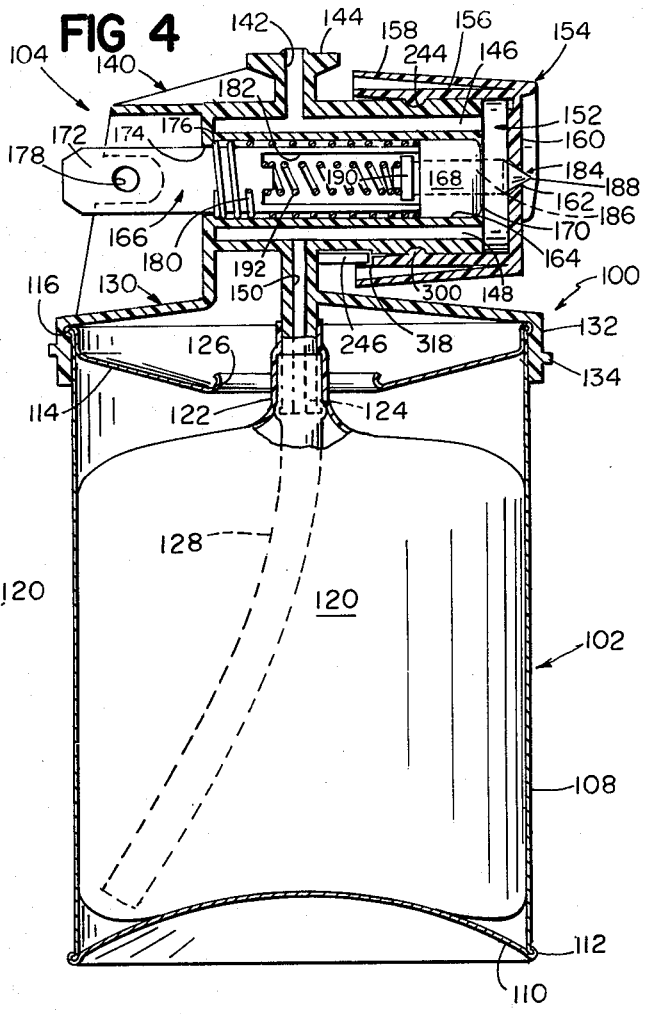
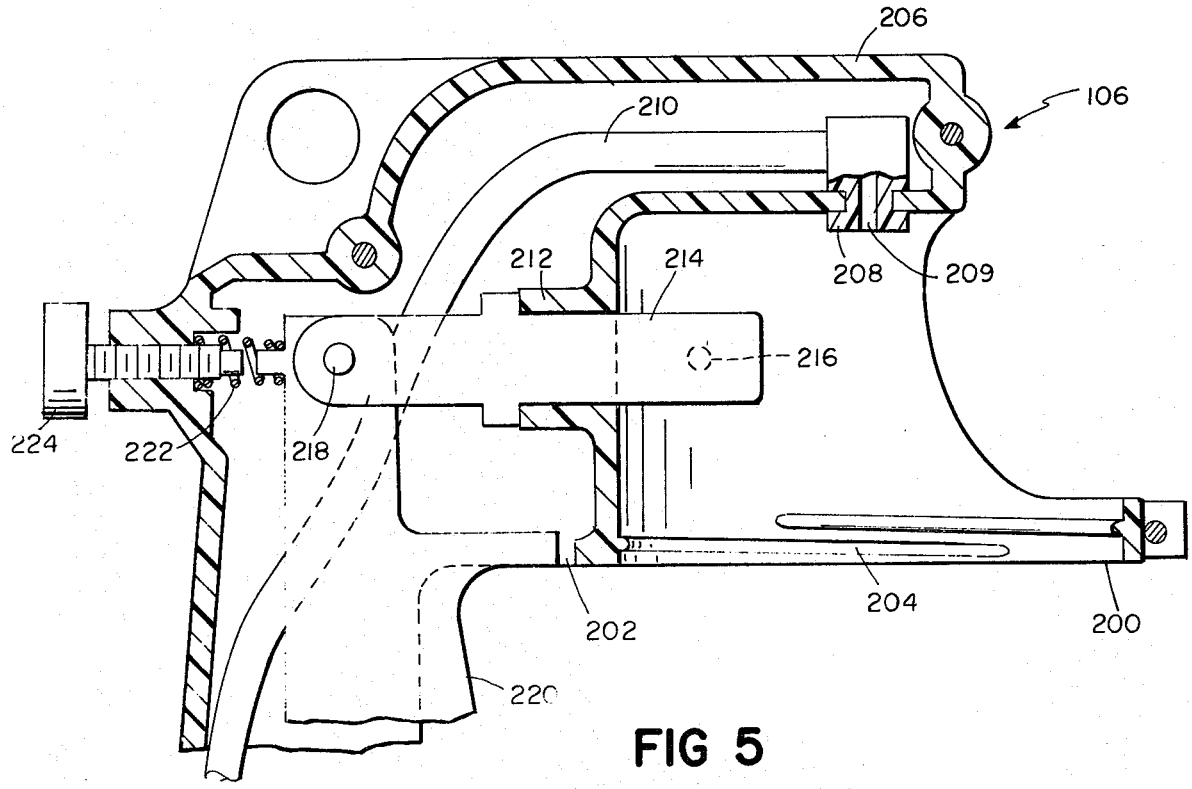
FIG 5

FIG 6
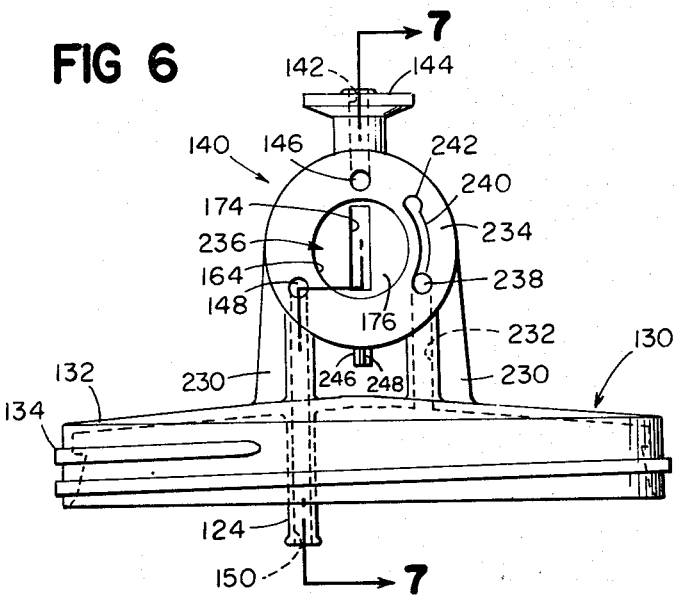
FIG 17
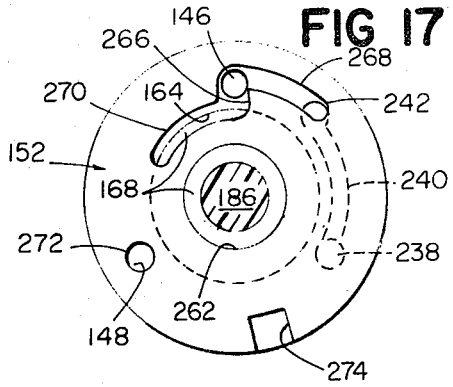
FIG 19
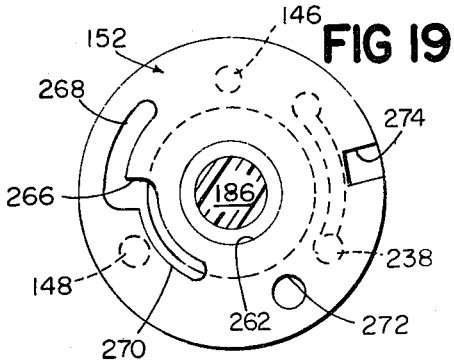
FIG 7
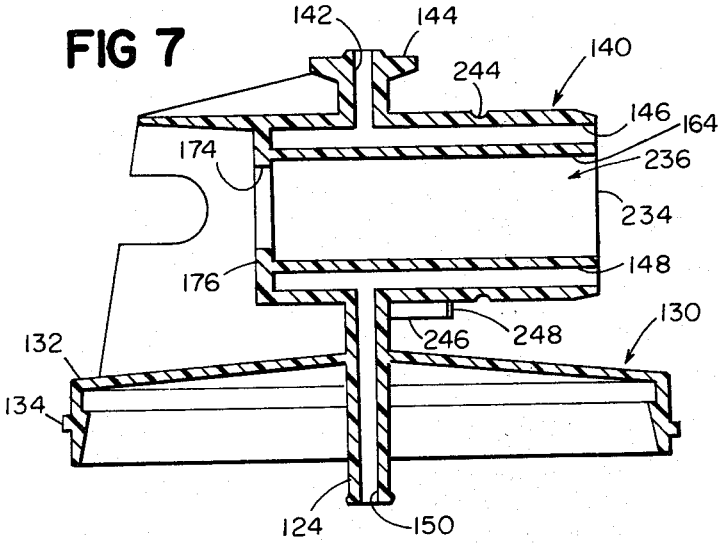
FIG 20
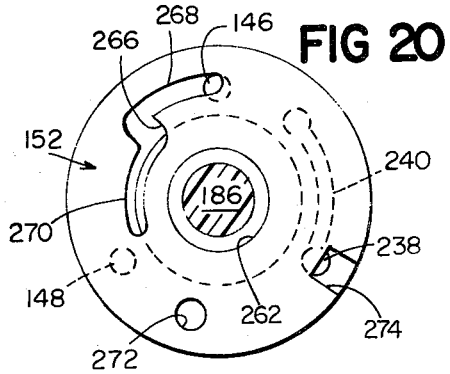
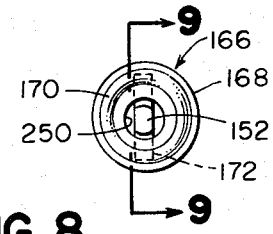
FIG 8
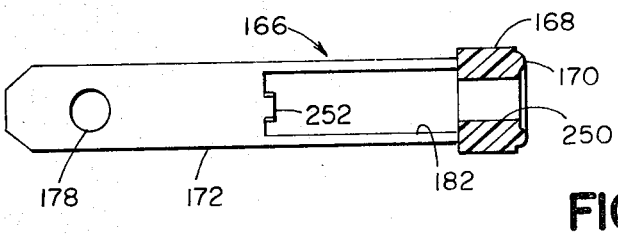
FIG 9
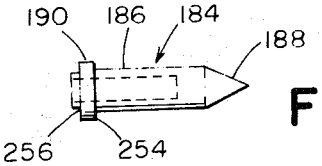
FIG 10

FIG 11
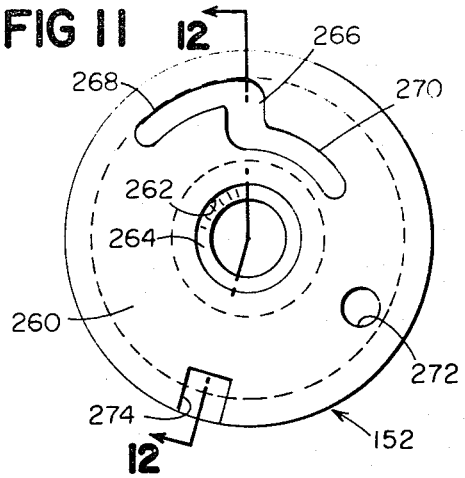
FIG 12
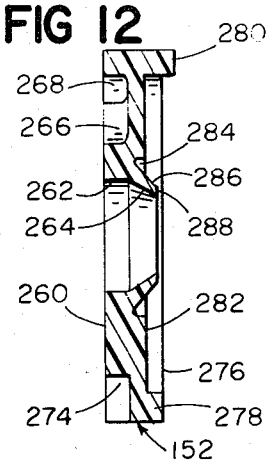
FIG 13
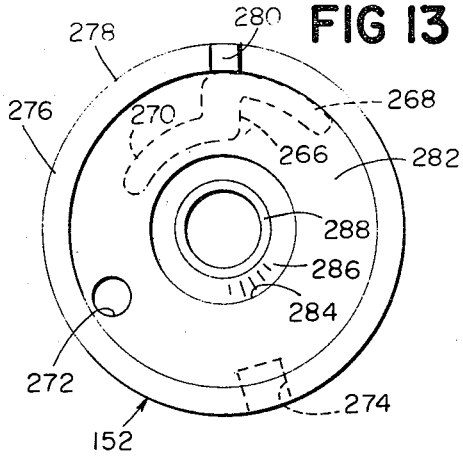
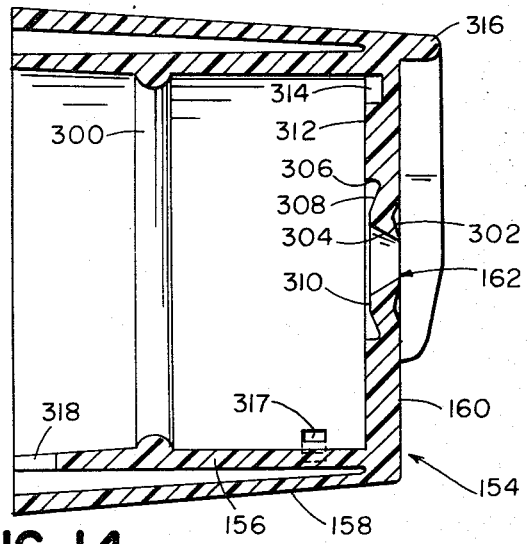
FIG 14
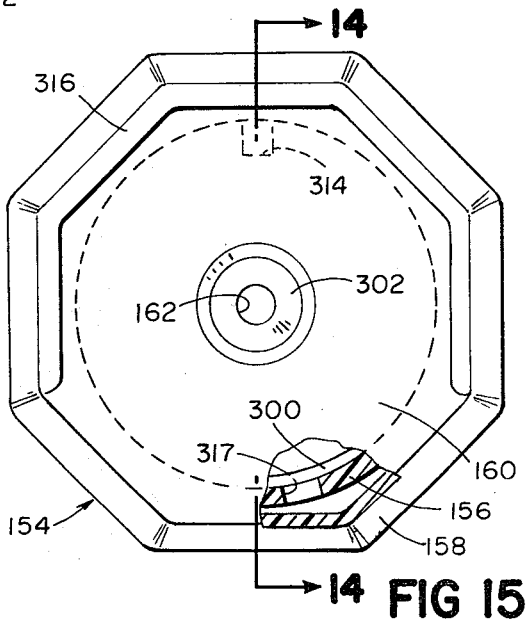
FIG 15
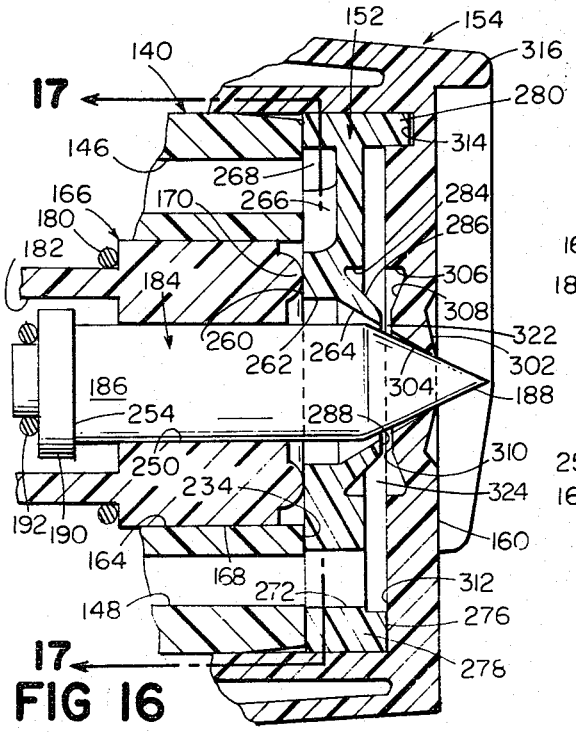
FIG 16
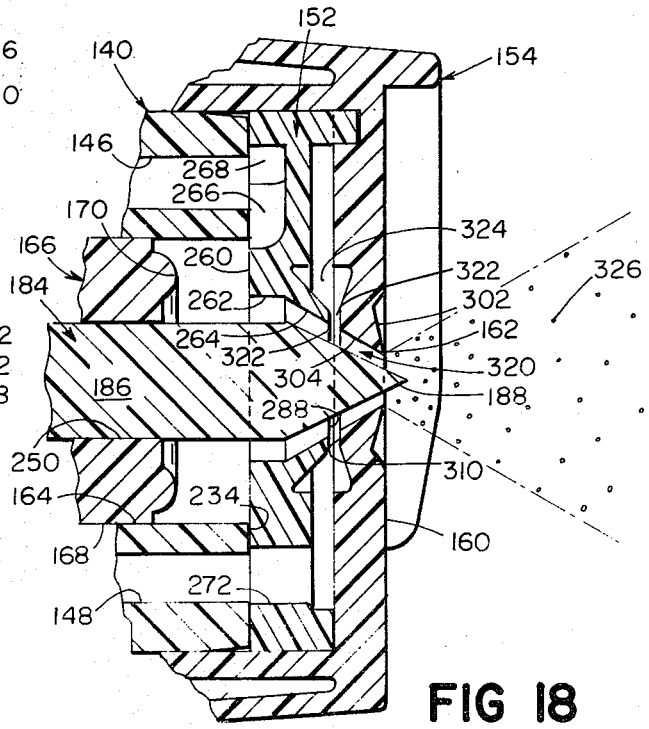
FIG 18

SPRAY NOZZLE

BACKGROUND OF THE INVENTION

1. Field of the Invention

This invention relates to a spray nozzle which, although of more general utility, is particularly suited for spraying liquids at low pressure from a hand-held spray device with contained propulsion power source, such as a battery operated paint sprayer.

2. Description of the Prior Art

Hand-held spray devices of the prior art with self-contained propellant power sources have in general required large propellant power, such as gas pressure of the order of 70 p.s.i. provided by fluorocarbons, hydrocarbons or like propellants of the so-called aerosol type of such device in most general use. Devices using as the propellant air compressed by electrically operated compressors have generally also been designed to utilize high propellant gas pressure, with electric power requirements beyond the capacity of batteries suitable for inclusion in a hand-held spray device. Accordingly, such electrically-operated devices have had to suffer the disability of requiring connection to an external electric power source and/or compressor.

It has been ascertained that a reason for the use of such high pressure propulsion power has been the lack of a spray nozzle structure which would produce a satisfactory spray without it. In particular, the nozzles utilized have required such high propulsion gas pressures to effectively break up the liquid into a suitable droplet spray.

SUMMARY OF THE INVENTION

An object of this invention is to provide a spray nozzle structure suitable for forming even viscous liquids, such as paint, into a spray of high droplet uniformity and confined regular pattern with the aid of only low gas propellant pressures, of the order of 4 p.s.i. or less, such as can readily by supplied by an electric compressor and operating batteries of size and weight suitable for containment in a hand-held spray device.

Another object is to provide such a nozzle structure which, at the low propellant gas pressures mentioned, produces a spray at least as suitable for like purposes as the sprays of conventional aerosol spray devices.

Additional objects are to provide such a nozzle which operates satisfactorily at low volume flow of compressed air at the low pressures mentioned, which does not externally foul with the sprayed material and is internally sealable when not in operation, which may be made in small size and at low cost suitable for integral throw-away attachment to containers in which liquids to be sprayed are sold, and which, while having the foregoing advantages, is also of more general utility, for example, to replace with advantage existing nozzle structures in uses where higher propellant gas pressures are available.

A spray nozzle in accordance with the invention has a nozzle body defining therein a tubular chamber with an outer wall of generally circular cross-section. A generally coaxial discharge orifice at an end of this chamber has a bounding surface externally of the chamber which forms an included angle toward the chamber of less than 110° with the axis of the chamber. Passage means are provided in the nozzle body to receive a flow of liquid to be sprayed and having an outlet arranged to discharge the liquid into the chamber as an annulus about the axis of the chamber. Means is provided for directing gas under pressure into the chamber in a flow path past the outlet and out the orifice, with any chamber wall portions defining the flow path between the outlet and the orifice being convergent toward the orifice in the direction of flow.

In preferred embodiments, the chamber outer wall is frusto-conical with the discharge orifice at the smaller end, an open-faced annular groove in this wall forms the annulus of liquid to be sprayed spaced from the orifice ½ to 3 times the diameter of the orifice, and the chamber is provided with an inner wall forming member of like shape and smaller included angle which is movable axially of the chamber to close or open the outlet, and the bounding surface of the discharge orifice forms an included angle toward the chamber with the chamber axis of less than 90°, such as 75°.

A chamber with a cylindrical outer wall produces an acceptable spray only if the annulus of liquid to be sprayed is located directly at the outlet orifice, so that there is essentially no wall area between the annulus and the orifice. Otherwise, the drop size is too irregular and there is too much overspray (e.g. an excessively fine fog which drifts away). The preferred frusto-conical shape of this wall produces a better, more uniform spray with less overspray and less air power required, particularly when the annulus forming groove is in the preferred location and the inner wall forming member is provided. The annulus may be formed on the inner wall provided by this member, but the spray is less satisfactory. If the outlet orifice has a cylindrical throat of any appreciable length between the orifice exit plane and the annulus, the spray is not satisfactory. The included angle toward the chamber between the outlet orifice external bounding surface and the chamber axis should be below 110° and the nozzle produces a better spray if that angle is less than 90°.

The size of the discharge orifice is not critical, its optimum size being determined by such factors as viscosity of the liquid to be sprayed, spray area desired at a given distance therefrom, volume of pressurized gas available, and volume of spray liquid flow desired, the chosen diameter being as small as consistent with such factors. For paint spraying with air pressurized to 3 to 4 p.s.i. and flow rates of 12 to 30 cubic feet per hour (0.35–0.85 $m^3$/hr.), a discharge orifice diameter of 0.055 inch (0.138 cm) has been found suitable. The presence of the preferred movable inner wall forming member has the additional advantage that its axial position can be adjusted to vary the construction of the gas flow passage between it and the outer chamber wall, thus increasing or decreasing the gas flow rate at a given pressure, and also changing the amount of liquid sprayed per unit time.

In contrast to many prior art nozzles which utilizes a swirling gas stream to atomize the liquid before ejection, the nozzle according to the invention does not need swirling gas, and preferably the compressed gas, normally air, is directed in a generally linear flow directly toward the discharge orifice with substantially no angularity about the chamber axis. With the preferred construction mentioned, observation indicates that such flow forms a continuous, thin film flow of the liquid to be sprayed from the annulus to the discharge orifice along the converging outer wall of the chamber. Due to the included angle mentioned between the chamber axis and the external bounding surface of the discharge orifice, the film encounters a sharp corner as it reaches the orifice. As it passes this corner, the film breaks into substantially uniform droplets that are dispersed in the stream as a homogeneous spray that forms a frusto-conical pattern as it progresses away from the nozzle orifice. Larger included angles than the maximum specified above are not suitable because they are large enough to support film flow around the intersection, thus impairing the spray forming action described, tending to form intermittent large drops. The angular relation of orifice bounding surface and chamber axis has another advantage in that the surface is out of the path of any overdivergent spray drops near the orifice. The exterior of the nozzle is thus antifouling, which is important when the nozzle is used for spraying viscous materials such as paint.

The preferred embodiment for hand operated sprayers disclosed herein is also disclosed in application of Roger Demler and myself filed contemporaneously herewith and assigned to the assignee of the present application, which is directed to certain features thereof. In that embodiment, the inner wall forming member is a valve head which is spring-urged to a position in which its smaller end seats against the rim of the discharge orifice to seal the interior of the nozzle when not in use. Means is provided for sealing the liquid supply passages from the gas supply passages when the valve head is in this position. Handle leverage is provided for retracting the valve for spray operation. A valve is provided to seal the liquid flow passages to the annulus forming outlet when the device is not in use. The nozzle may have its inlet for liquid to be sprayed integral with a cover for a container of such liquid and may be provided with passages for discharging air under pressure through the cover into the container.

A typical nozzle of preferred construction suitable for spraying paint at a propellant gas pressure of 3 to 4 p.s.i. may have a discharge orifice diameter of 0.050 to 0.055 inch (about ⅛ cm), a frusto-conical chamber outer wall with an included angle of 60°, an annulus-forming groove in that wall 0.015 inch (about 0.4 mm) wide and about the same depth, spaced 0.065 to 0.110 inch (about 0.16 to 0.28 cm) from the nozzle outlet, and a valve head with an included angle of 50°. Liquid flow through the nozzle may be produced in a variety of ways. The nozzle may be self-aspirating if the pressure head due to speed of the gas at the annulus reduces the pressure sufficiently below the pressure on the liquid. Gravity flow may be utilized if the nozzle is located below the spray liquid source level. Pressure may be supplied to the source to cause or assist in the flow. A liquid flow rate of about 45 c.c. per minute at 4 p.s.i. air flow of about 30 cubic feet per hour (0.85 $m^3$/hr.) has been found well suited for paint spray.

BRIEF DESCRIPTION OF THE DRAWINGS

In the accompanying drawings:

FIG. 3 is a front elevation view (with parts broken away) of dispensing apparatus that includes a nozzle body according to the invention;

FIG. 4 is a cross-section view taken along the line 4—4 of FIG. 3;

FIG. 5 is a cross-section view of a hand-held air supply and operator unit to which the dispenser unit of FIGS. 3 and 4 is releasably attachable;

FIG. 6 is a front elevation view of the dispenser body and container cover of the dispenser unit shown in FIG. 3;

FIG. 7 is a cross-section view taken along the line 7—7 of FIG. 6;

FIG. 8 is a front elevation view of an axially movable valve member employed in the dispenser unit shown in FIG. 3;

FIG. 9 is a cross-section view taken along the line 9—9 of FIG. 8;

FIG. 10 is a side elevation view of the discharge orifice valve member employed in the dispenser unit shown in FIG. 3;

FIG. 11 is a rear elevation view of a valve disc employed in the dispenser unit shown in FIG. 3;

FIG. 12 is a cross-section view taken along the line 12—12 of FIG. 11;

FIG. 13 is a front elevation view of the valve disc of FIG. 11;

FIG. 14 is a cross-section view taken along the line 14—14 of FIG. 15;

FIG. 15 is a front elevation view of the nozzle cap of the dispensing unit shown in FIG. 3;

FIG. 16 is an enlarged cross-section view of the discharge chamber of the dispensing unit of FIG. 3 showing the axially movable valve members in closed position and the rotary valve in open position;

FIG. 17 is a diagrammatic view taken along the line 17—17 of FIG. 16;

FIG. 18 is a view, similar to FIG. 16, with the axially movable valve members in open position for spraying paint; and FIG. 19 and 20 are diagrammatic views, similar to FIG. 17, showing the rotary valve in a closed position and in an intermediate position respectively.

DESCRIPTION OF THE PREFERRED EMBODIMENTS

Figure 1:
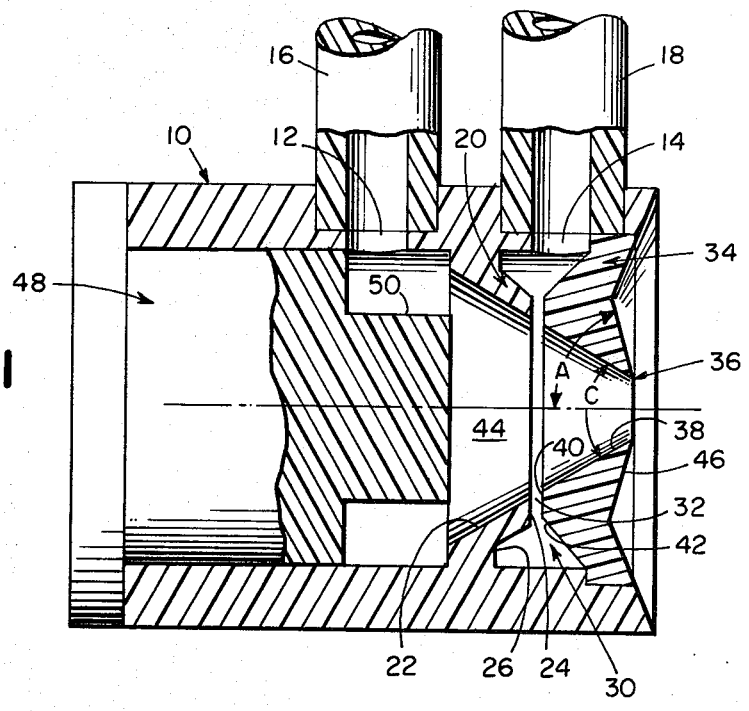
FIG. 1 is an enlarged longitudinal cross-section view through a nozzle body according to the invention.

Referring first to FIG. 1, the nozzle body shown, designated generally 10, is a hollow cylinder provided in its side with a pair of radially directed ports 12 and 14 to which are press-fitted respectively the ends of tubes 16 and 18. Tube 16 connects port 12 to a source of air under pressure (not shown) while tube 18 connected port 14 to a source of liquid to be sprayed (not shown). Between ports 12 and 14 an annular ledge 20 projects inwardly toward the axis of the body. Ledge 20 has a frusto-conical inner surface 22, a flat end surface 24 and an annular groove 26. Groove 26 forms one side of an annular reservoir 30 for liquid to be sprayed communicating with port 14. End surface 24 forms one side of an annular slot passage 32 opening from reservoir 30 into the interior of body 10 at the forward extremity of surface 22.

The forward end of nozzle body 10 has press-fitted thereto a disc member designated generally 34 which closes the forward end of the body except for a central orifice therein, which forms the outlet orifice 36 for the spray. Orifice 36 is bounded interiorly of member 34 by a frusto-conical surface 38 having the same cone angle C as surface 22, as shown about 60°. A flat surface 40 at the inner end of surface 38 is spaced from surface 24 to form the opposite side of annular slot passage 32. The outer end of surface 40 joins inclined annular surface 42 which defines with groove 26 the annular reservoir 30.

Surface 22 and its continuation by surface 38 beyond passage 32 define the outer wall of a frusto-conical inner chamber 44 of nozzle body 10. The exterior surface 46 of member 34 bounding orifice 36 defines an included angle A toward chamber 44 with the axis of the chamber which is less than 110°, and as shown is formed as a frusto-conical surface with such included angle being about 75°.

Figure 2:
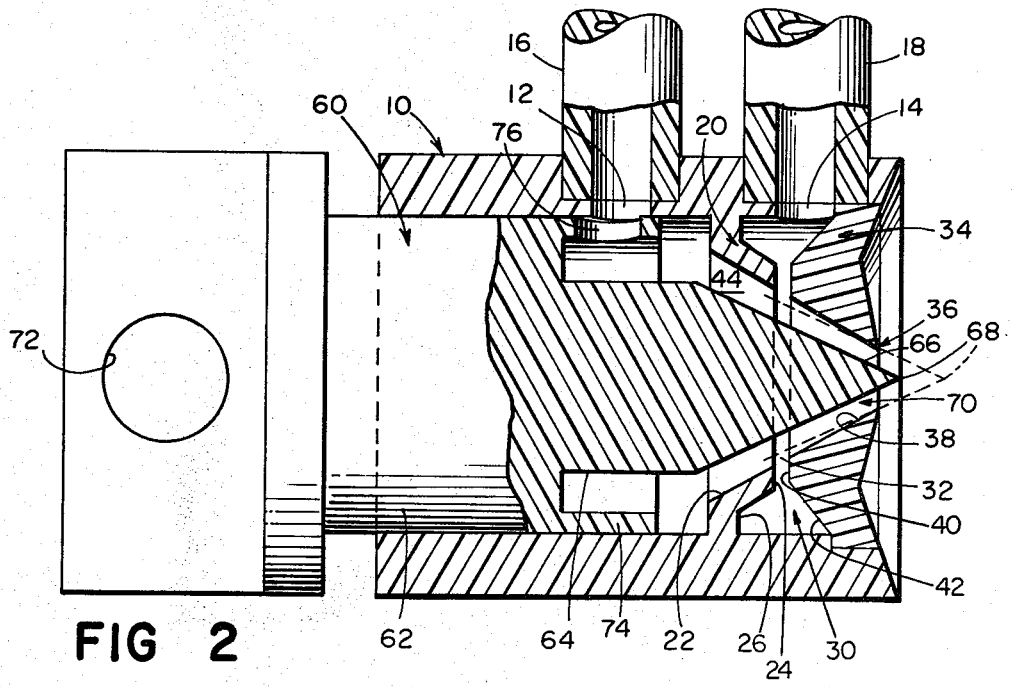
FIG. 2 is a similar view of another nozzle body according to the invention.

Although the use of an inner wall forming member is preferable as in FIG. 2, the nozzle of FIG. 1 functions effectively without such a member, in which case its open rearward end is closed by a plug 48. Desirably, such a plug has a reduced portion 50 opposite port 12 to distribute the pressurized gas from the port evenly about the axis of chamber 44. Valves (not shown) in tubes 16 and 18 control the flow of gas and liquid respectively. The liquid to be sprayed passes from tube 18 through port 14 to reservoir 30 and is discharged therefrom as an annulus about the axis of chamber 44 through slot passage 32. The pressurized gas, sweeping past the outlet of passage 32, removes liquid from the annulus and causes it to flow as a thin film along convergent outer wall 38 and as an annular continuous thin film at the sharp corner of discharge orifice 36 between surfaces 38 and 46. The liquid and the parallel flow of gas accelerate smoothly as they progress towards discharge orifice 36 across the bounding surface 38 of decreasing area. As the liquid film passes the sharp corner of discharge orifice 36, the pressurized gas flowing parallel with the liquid abruptly expands through the liquid film and breaks up that film into a spray of generally conical pattern and uniform drop size.

As shown, the annulus forming outlet of passage 32 is spaced from orifice 36 about 1¼ times the orifice diameter. As earlier stated herein, this outlet is preferably spaced from the orifice from ½ to 3 times the orifice diameter, although it may be located directly at the orifice with only a plate of negligible thickness forming its outer surface. In any event, any wall surfaces within the nozzle contacting the gas flow between the annulus outlet and the orifice are convergent toward the axis of the nozzle chamber.

FIG. 2 shows the nozzle of FIG. 1 with the same reference numerals applied thereto, provided with an inner wall forming member in the chamber 44. The use of such a member is preferred, both for its functional effect on the gas flow and because of its ability to act as a seal for the spray discharge orifice when the nozzle is not in operation. A piston of circular cross-section designated generally 60, which replaces the plug 48 in FIG. 1, has a reduced portion 62 which slidably fits within the cylindrical opening at the rearward end of nozzle body 10, with sufficient closeness to prevent the flow of pressurized gas out the rearward end of the body. A further reduced portion 64 of piston 62 has a conically shaped forward end portion 66 coaxial with chamber 44 but of smaller cone angle which extends from its larger end at the rear of passage 32 to its tip 68.

At the fully inserted position of piston 60 shown in dash lines, circular orifice 36 tightly engages about conical portion 66 with tip 68 projecting through it to seal chamber 44 from ambient air. When piston 60 is retracted from this position to a position such as shown by full lines in FIG. 2, orifice 36 is opened except for so much of tip portion 68 as may project through it. The conical end portion of piston 60, forming an inner wall for chamber 44, opposite and spaced from surfaces 22 and 38, defines with those surfaces a conical sleeve flow path 70 of diminishing thickness toward orifice 36 for the pressurized gas, past the outlet of passage 32 and out the orifice.

An aperture 72 in the external rearward end of piston 60 serves as a coupling means, via a pin inserted therein, for trigger linkage (not shown) for reciprocating the piston between open and closed positions. Where, as in FIG. 2, a spring is not provided in the nozzle itself, such trigger linkage may be biased to normally maintain the piston in nozzle-closing position. For uses in which sealing of the nozzle is not desired, as where the nozzle operates in a combustion system, the piston 60 may be fixed in an open position.

Portion 64 of piston 60 has an annular surrounding channel 74 formed therein, having one end open toward orifice 36. A port 76 in the outer wall of channel 74 communicates with compressed gas inlet 12 to provide equalized distribution of the gas about the nozzle axis and substantially uniform flow thereof toward orifice 36. In FIG. 2, as in FIG. 1, the gas flow is past the annulus formed by passage 32 and out the orifice 36 and is essentially non-angular. However, swirling flow may be utilized, formed for example by one or more tangential gas inlet ports.

Shown in FIGS. 3 and 4 is a paint dispensing unit 100 of the throw-away type that includes a cylindrical container 102 and integral dispensing head unit 104. This replaceable unit is designed for releasable attachment to the hand-held operating unit 106 shown in FIG. 5. Container 102 includes a rigid outer can that has cylindrical side wall 108, bottom wall 110 secured to side wall 108 by bead 112, and upper wall 114 secured to side wall 108 by bead 116. Within the rigid can is a compressible bag 120 of flexible material that contains the liquid paint to be sprayed. Bag 120 has a neck portion 122 that is secured over depending stem 124 and extends through opening 126 in upper can wall 114. Dip tube 128 extends from stem 124 towards the bottom of bag 120. Formed integrally with, and surrounding, stem 124 is container cover 130 that has an annular flange 132 that is sealed to the annular bead 116 of container 102. A helical rib 134 is on the outer periphery of flange 132.

Integral with cover 130 and connected to stem 124 is dispensing head 104 which includes a housing member 140 with a gas inlet passage 142 and coupling flange 144 on its upper side. Formed in housing 140 is an axially extending gas flow passage 146 connected to gas inlet passage 142, and axially extending liquid flow passage 148 connected to the passage 150 through stem 124. A rotary valve disc 152 is seated on the front surface of the dispenser housing 140 and secured in position by nozzle cap 154 that includes a cylindrical sleeve 156, a protective skirt 158, and a front wall 160 in which is disposed discharge orifice 162.

Formed within housing 140 is a cylindrical chamber having a wall 164 in which is disposed a reciprocable member 166 (shown in greater detail in FIGS. 8 and 9) that has a cylindrical valve head 168 with an annular valve bead 170 on its front face and a rearwardly extending bar portion 172 which passes through aperture 174 in rear chamber wall 176. A coupling aperture 178 is provided in the rear end of bar portion 172. Spring 180 acts between rear chamber wall 176 and cylindrical head 168 to urge the valve head 170 forward into sealing engagement with the rear surface of valve disc 152. Bar portion 172 has an aperture 182 and valve head 168 has a bore in which is disposed orifice valve member 184. That valve member has a cylindrical body 186, a conical nose 188 and a hub flange 190. Spring 192 acts between the rear wall of aperture 182 and hub flange 190 to urge valve member 184 forward so that its conical nose 188 extends through and closes discharge orifice 162.

The cooperating hand-held operating unit 106 shown in FIG. 5 includes a coupling ring 200 that extends forward from support frame 202. Formed in the inner surface of ring 200 is a helical rib 204. Above support ring 200 is cantilever arm 206 that carries a resilient coupling 208. A central bore 209 in coupling 208 is connected by tube line 210 to a battery powered compressor (not shown) that supplies compressed air at a pressure of about 4 p.s.i. Also formed in frame 202 is boss 212 that slidingly carries reciprocable link 214 which has a connecting pin 216 at its forward end and a pivot connection 218 to trigger 220 at its rear end. Trigger 220 and link 214 are biased forwardly by spring 222. Adjustment member 224 controllably limits the rearward movement of the trigger and link assembly.

The container-dispensing head unit 100 is attached to hand-held operating unit 106 by inserting the dispensing head 104 upwardly through ring 200 so that flange 144 is in alignment with resilient coupling 208 and angularly aligning helical ribs 134 and 204 to be in cooperating relation. The dispensing unit 100 is then rotated until link pin 216 enters and is latched in bar aperture 178. In this position, flange 144 is seated against resilient coupling 208, providing a seal between air supply line 210 and passage 142. The axially movable valve assembly of members 166 and 184 is coupled to trigger 220 by link 214 so that operation of the trigger moves orifice valve member 184 and cylindrical valve head 168 rearwardly to open the chamber valve and the discharge orifice valve.

The dispenser housing member shown in FIGS. 6 and 7 is of molded plastic. That housing member includes container cover 130 and the cylindrical housing body 140 connected by webs 230. Stem passage 150 passes through one web and a second passage 232 passes through a second web. The housing body 140 has a planar front face 234 with a central axially extending cylindrical chamber 236 defined by wall 164. Three axially extending passages 146, 148 and 238 extend rearwardly from front face 234. Also formed in front face 234 is an arcuate groove 240 that has an angular length of about 90°. One end of groove 240 is in communication with passage 238, the other end 242 of the groove has a width equal to the passage width, and the intermediate section of the groove 240 is of reduced width. Passage 146 is at the top of the cylindrical housing and in communication with air inlet passage 142; passage 148 is offset 120° from passage 146 and in communication with liquid supply passage 150; and passage 238, offset 120° from passage 148, is in communication with passage 232 that extends through cover 130. An annular groove 244 is formed in the outer surface of housing 140, and a stop projection 246 with a detent 248 is at the base of the housing between the webs 230.

Valve member 166 is of molded plastic and has a length of about six centimeters or less and its head 168 has a diameter of about one centimeter or less. As shown in FIGS. 8 and 9, that valve member includes cylindrical head 168 with annular valve rib 170 formed on its front surface and a cylindrical through passage 250. Extending rearwardly from head 168 is elongated bar portion 172 of rectangular cross-section. Formed in bar portion 172 adjacent cylindrical head 168 is an elongated aperture 182 with a post 252 at its rear edge which defines a spring guide.

The orifice valve member 184 shown in FIG. 10 is also a molded plastic member and is about two centimeters or less in length with a cylindrical body portion 186 about ½ centimeter or less in diameter. Its conical nose 188 has an included angle of 50°. The hub 190 at the rear of body 186 has a front stop surface 254 and a rear spring seat surface 256.

The valve disc 152, shown in FIGS. 11–13, is a molded plastic member of about 4½ centimeters or less in diameter and about ⅓ centimeter in thickness. Its rear surface 260 seats on front surface 234 of housing 140. The disc has a central through passage that has a cylindrical section defined by surface 262 and a convergent section defined by frusto-conical surface 264 at an angle of 30° to the axis of disc 152. Formed in rear surface 260 at the upper side as shown in FIG. 11 is a recess that includes a central portion 266 that has a radial length of about ¾ centimeter, a first arcuate portion 268 that extends from the outer edge of central portion 266 and has an angular length of 45° and a second arcuate portion 270 that extends from the inner edge of central portion 266 in the opposite direction and has an angular extend of 60°. Through passage 272 is angularly offset by 120° from the central portion 266, and vent notch 274 that extends to the periphery of disc 152 is angularly offset from passage 272 by 75°. The front surface 276 of disc 152 is defined by rim 278. Projecting forwardly from rim 278 is tooth 280. Extending inwardly from rim 278 is a recessed planar surface 282 that terminates in annular groove 284. The inner wall 286 of groove 284 slopes inwardly and terminates at a planar rim surface 288 that is about 0.2 millimeter below surface 276.

The nozzle cap 154, also of molded plastic, is shown in FIGS. 14 and 15. That cap includes a cylindrical body section 156 that has an annular rib 300 formed on its inner surface that is adapted to be seated in annular groove 244 of housing 140 (FIG. 7), a skirt 158 of octagonal shape as indicated in FIGS. 3 and 15, and a front wall 160 in which discharge orifice 162 is provided. Orifice 162 is defined by the intersection of annular surfaces 302 and 304, surface 302 being disposed at an angle of 75° to the axis of cap 154 and surface 304 being disposed at an angle of 30° to that axis. Also formed in the rear surface of front wall 160 is an annular groove defined by cylindrical surface 306 and inclined surface 308 that terminates in annular rim surface 310 that extends to conical surface 304. Rim surface 310 is about 0.2 millimeter below the rear surface 312 of wall 160. At the upper edge of the surface 312 is a recess 314 which receives tooth 280 of valve disc 152. A forwardly projecting lip 316 is disposed above and on either side of discharge orifice 162 as an extension of skirt 158; a vent port 317 extends through body 156; and a limit slot 318 (about 90° in angular extent) is at the rear edge of body 156.

In assembly, valve disc 152 is inserted into the nozzle cap with tooth 280 in recess 314 and surface 278 seated on surface 312 as a first subassembly. Orifice valve 184 is inserted through bore 250 of valve member 166 and spring 192 is positioned between seats 252 and 256 so that the orifice valve 184 is urged forward and its hub surface 254 is seated against the rear surface of valve head 168. That valve subassembly, together with biasing spring 180 is inserted into the cylindrical cavity 236 of the housing body 140 with the rear end of bar 172 extending through aperture 174. The cap-valve disc subassembly is then inserted over the outer surface of housing 140 with rib 300 seated in groove 244. Indexing stop 246 is received in slot 318. In this position, the nozzle cap-valve disc subassembly may be rotated through 90° as limited by the engagement of projection 246 and slot 318.

An enlarged cross-section view of the dispensing nozzle is shown in FIG. 16 with the axially movable valves in closed position and the rotary valve in open position. Frusto-conical surfaces 264 and 304 are aligned and form the outer wall of a convergent discharge passage 320 that terminates at discharge orifice 162. Surfaces 288 and 310 define an annular opening 322 in the outer wall of the discharge passage which is in communication with an annular reservoir 324 defined by surfaces 284, 286, 306 and 308. An annular passage extends radially outward from reservoir 324 to port 272 in disc 152. In the open position of the rotary valve disc, as indicated in FIG. 17, port 272 is in alignment with passage 148. In that valve position, the central portion 266 of the groove is in alignment with air supply passage 146, groove arm 268 bridges the end 242 of groove 240 in housing face 234, and the inner portion of groove arm 270 bridges cylindrical surface 164. Thus low pressure air supplied through passage 146 is applied to the annular chamber surrounding valve bead 170 and, through groove 240 and passage 238 and 232 is applied through container cover 130 to pressurize the compressible bag 120 of paint. The pressurized paint flows upwardly through dip tube 128, stem passage 150 and axial passage 148 towards the annular reservoir 324 surrounding the discharge passage 320. No dispensing occurs as valves 170 and 188 are closed.

When trigger 220 is operated, valve member 166 is pulled rearwardly, separating valve bead 170 from disc surface 260, and allowing air to flow into the dispensing passage 320. The rear surface of valve cylinder 168 engages hub 190 of orifice valve 184 and moves that valve rearwardly, opening orifice 162. The dispensing nozzle with both axially movable valves in open position is shown in FIG. 18. In this position pressurized air flows through the convergent discharge passage 320 across the liquid paint at the annular outlet 322. The parallel flows of liquid paint and air accelerate smoothly as they move through the discharge passage towards the discharge orifice 162 with an annularly continuous thin film of paint at the sharp orifice edge defined by surfaces 302 and 304. As the film of paint exits orifice 162, the flowing gas expands abruptly through that film and forms a conical spray of paint droplets 326 of small and uniform size.

This dispensing action continues until trigger 220 is released. Springs 180, 192 and 222 move the valve members 166 and 184 forward, the discharge orifice 162 being closed when nose 188 seats against it and the air supply passage to the discharge passage 320 being closed when valve rib 170 seats against disc surface 260. In this condition, the paint in bag 120 is sealed from the atmosphere.

The nozzle cap 154 may be rotated 90° (counterclockwise as viewed in FIG. 3) to close the rotary valve. In that position, as indicated in FIG. 19, all three housing passages 146, 148 and 238 are closed by the valve disc 152. The nozzle cap may be located in an intermediate position (45° from the open position) as shown in FIG. 20. In that position, the end of groove arm 268 overlies air supply passage 146 so that pressurized air is supplied to the chamber surrounding valve rib 170; and the vent passage (notch 274 and port 317) is in communication with passage 238. The paint supply passage 148 is closed. In this intermediate position, the upper portion of container 102 is vented to atmosphere, relieving the pressure on bag 120. If trigger 220 is depressed, the ports closed by axially movable valve members 166 and 184 are opened and air flows through the dispensing passage 320 without flow of additional paint from bag 120, thereby permitting the nozzle passage to be cleared of any residual paint.

Other embodiments are within the scope of the invention and claims.

What is claimed is:

1. A spray nozzle particularly suitable for forming a liquid spray of high droplet uniformity with a low pressure gas comprising:

a nozzle body having therein a tubular chamber of generally circular cross-section, said tubular chamber having an axially extending wall surface;

a discharge orifice at one end of said chamber generally coaxial thereto and provided externally of said chamber with a bounding surface which forms an included angle toward the chamber with the axis of said chamber of less than 110°;

an annular outlet in said axially extending wall surface extending as an annulus about the axis of said chamber;

passage means in said body arranged to supply a flow of liquid to be sprayed to said annular outlet for discharge of the same through said annular outlet into said chamber as an annulus about the axis of said chamber; and means for directing gas under pressure into said chamber in a flow path past said annular outlet and out said orifice, any wall portions of said chamber defining said flow path between said annular outlet and said orifice being convergent toward said orifice in the direction of flow.

2. A spray nozzle according to claim 1 wherein the gas flow path has substantially no angularity about the chamber axis.

3. A spray nozzle according to claim 1 wherein said chamber outer wall is of frusto-conical shape and said outlet is at the smaller diameter end thereof.

4. A spray nozzle according to claim 3 wherein said chamber is provided with a coaxial inner wall-forming member of similar shape to said chamber outer wall and having a smaller included angle.

5. A spray nozzle according to claim 1 wherein said outlet is spaced axially of said chamber from said orifice between ½ and 3 times the diameter of the orifice.

6. A spray nozzle according to claim 1 wherein said outlet comprises an annular groove in said chamber outer wall open to the interior of said chamber.

7. A spray nozzle according to claim 6 wherein said passage means includes an annular passage in said body of larger capacity than and communicating with said groove, and means are provided for connecting said passage to a source of said liquid.

8. A spray nozzle according to claim 1 wherein said included angle is less than 90°.

9. A spray nozzle according to claim 3 wherein the cone angle of said chamber outer wall is of the order of 60°.

10. A spray nozzle according to claim 9 wherein said included angle is less that 90°.

11. A spray nozzle comprising:

a nozzle body having therein a tubular chamber having an outer wall of generally circular cross-section and a coaxial inner wall of similar shape to said chamber outer wall and having a smaller included angle;

a discharge orifice at one end of said chamber generally coaxial thereto and provided externally of said chamber with a bounding surface which forms an included angle toward the chamber with the axis of said chamber of less than 110°;

passage means in said body arranged to receive a flow of liquid to be sprayed and having an outlet arranged to discharge the same through said annular outlet into said chamber as an annulus about the axis of said chamber; and means for directing gas under pressure into said chamber in a flow path past said annular outlet and out said orifice, any wall portions of said chamber defining said flow path between said annular outlet and said orifice being convergent toward said orifice in the direction of flow, the member defining said inner wall being movable axially of said chamber between a first position sealing said orifice and a second position providing said gas flow path between it and said chamber outer wall.

12. A spray nozzle according to claim 11 which includes manually controllable means connected to said member for moving said member between said positions.

13. A spray nozzle according to claim 12 wherein said outlet comprises an annular groove in said chamber outer wall open to the interior of said chamber and said outlet is spaced axially of said chamber from said orifice between one-half and three times the diameter of the orifice.

14. A spray nozzle according to claim 13 wherein said chamber outer wall is of frusto-conical shape and has a cone angle of the order of 60°, and said outlet is at the smaller diameter end thereof.

15. A spray nozzle according to claim 14 wherein said included angle is less than 90°.

16. A spray nozzle according to claim 15 wherein the gas flow path has substantially no angularity about the chamber axis.

17. A spray nozzle particularly suitable for forming a liquid spray of high droplet uniformity with a low pressure gas comprising:

a nozzle body having therein a tubular chamber having an outer wall of generally circular cross-section and of frusto-conical shape;

a discharge orifice at the smaller diameter end of said chamber generally coaxial thereto and provided externally of said chamber with a bounding surface which forms an included angle toward the chamber with the axis of said chamber of less than 110°;

passage means in said body arranged to receive a flow of liquid to be sprayed and having an annular outlet in said chamber outer wall arranged to discharge the flow of liquid into said chamber as an annulus about the axis of said chamber; and means for directing gas under pressure into said chamber in a flow path through said chamber past said outlet and out said orifice, said annular outlet being spaced axially of said chamber from said discharge orifice between one-half and three times the diameter of said discharge orifice, the wall portions of said chamber defining said flow path between said annular outlet and said discharge orifice being convergent toward said discharge orifice in the direction of flow.

* * * * *

UNITED STATES PATENT AND TRADEMARK OFFICE

CERTIFICATE OF CORRECTION

PATENT NO. : 4,175,706

DATED : November 27, 1979

INVENTOR(S) : Joseph Gerstmann

It is certified that error appears in the above–identified patent and that said Letters Patent are hereby corrected as shown below:

Col. 2, line 51, "construction" should read --constriction--.

Signed and Sealed this

*Eleventh* Day of *March 1980*

[SEAL]

*Attest:*

SIDNEY A. DIAMOND

*Attesting Officer*

*Commissioner of Patents and Trademarks*